US010697642B2

(12) United States Patent
Corral Ricalde et al.

(10) Patent No.: US 10,697,642 B2
(45) Date of Patent: Jun. 30, 2020

(54) GAS COOKER AND COOKING HOB ARRANGEMENT

(71) Applicant: BSH Hausgeräte GmbH, Munich (DE)

(72) Inventors: Javier Corral Ricalde, Muriedas (ES); Sergio Llorente Gil, Saragossa (ES); Jose Salvador Ochoa Torres, El Astillero (ES); Julio Rivera Peman, Cuarte de Huerva (ES); Cristina Rueda Sanudo, Escobedo de Camargo (ES)

(73) Assignee: BSH Hausgeräte GmbH, Munich (DE)

( * ) Notice: Subject to any disclaimer, the term of this patent is extended or adjusted under 35 U.S.C. 154(b) by 62 days.

(21) Appl. No.: 15/773,176

(22) PCT Filed: Oct. 26, 2016

(86) PCT No.: PCT/IB2016/056430
§ 371 (c)(1),
(2) Date: May 3, 2018

(87) PCT Pub. No.: WO2017/085580
PCT Pub. Date: May 26, 2017

(65) Prior Publication Data

US 2018/0320904 A1 Nov. 8, 2018

(30) Foreign Application Priority Data

Nov. 17, 2015 (ES) ..... 201531664

(51) Int. Cl.
*F24C 3/12* (2006.01)

(52) U.S. Cl.
CPC ..... *F24C 3/126* (2013.01); *F24C 3/12* (2013.01)

(58) Field of Classification Search
CPC ..... F24C 3/126; F24C 3/12; F23D 2208/10
See application file for complete search history.

(56) References Cited

U.S. PATENT DOCUMENTS

| | | | | |
|---|---|---|---|---|
| 5,549,382 | A | 8/1996 | Correia, II et al. | |
| 6,554,197 | B2 * | 4/2003 | Marbach | F23N 5/022 126/374.1 |
| 2002/0130190 | A1 | 9/2002 | Marbach et al. | |

FOREIGN PATENT DOCUMENTS

| | | | |
|---|---|---|---|
| CN | 1263228 | A | 8/2000 |
| CN | 201652487 | U | 11/2010 |
| CN | 202101293 | U | 1/2012 |
| JP | H08136359 | A | 5/1996 |
| JP | 2002340339 | A | 11/2002 |

(Continued)

OTHER PUBLICATIONS

National Search Report CN 201680067282.4 dated Mar. 5, 2019.

(Continued)

*Primary Examiner* — Alfred Basichas
(74) *Attorney, Agent, or Firm* — Michael E. Tschupp; Andre Pallapies; Brandon G. Braun

(57) ABSTRACT

A gas cooking zone includes a gas burner having a burner base, a burner cover and a plurality of gas outlet ports, with the gas outlet ports being arranged on a closed curve, An infrared sensor device is arranged on the closed curve or offset in a radially outward direction from the closed curve and ascertains a temperature of a cooking receptacle associated with the gas cooking zone. The infrared sensor device is configured to at least partially penetrate the burner base and the burner cover.

26 Claims, 7 Drawing Sheets

(56) References Cited

FOREIGN PATENT DOCUMENTS

| | | | |
|---|---|---|---|
| JP | 2005172332 | A | 6/2005 |
| JP | 2006207962 | A | 8/2006 |
| JP | 2008249176 | A | 10/2008 |
| JP | 2011163759 | A | 8/2011 |
| WO | 2015049600 | A1 | 4/2015 |

OTHER PUBLICATIONS

International Search Report PCT/IB2016/056430 dated Dec. 21, 2016.
National Search Report ES 201531664 dated Nov. 11, 2016.

* cited by examiner

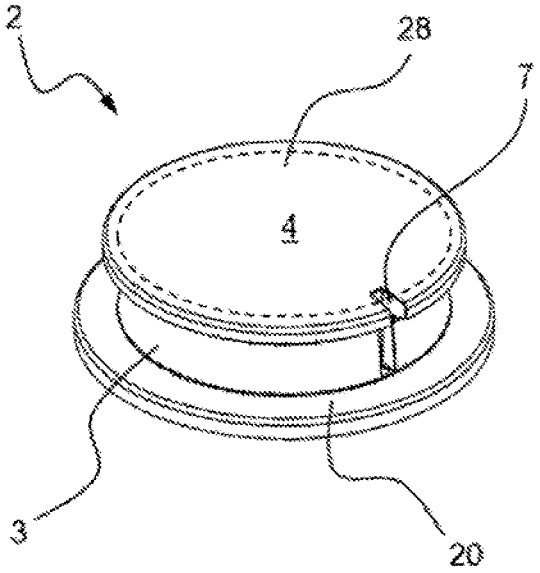
Fig. 4A Amended
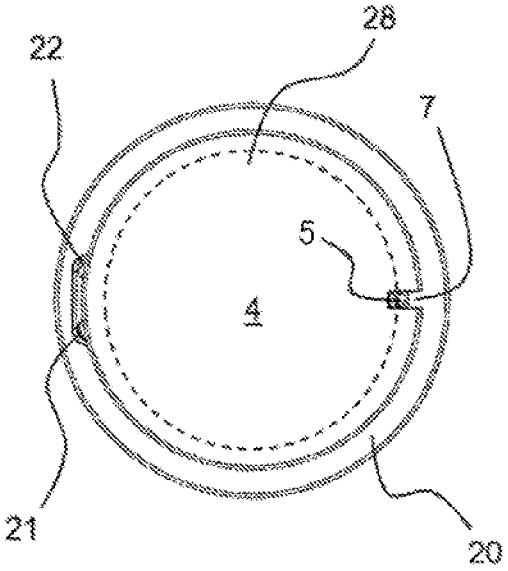
Fig. 4B Amended
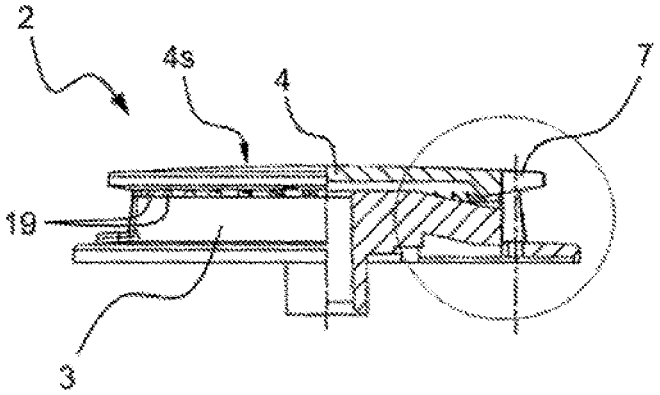
Fig. 5

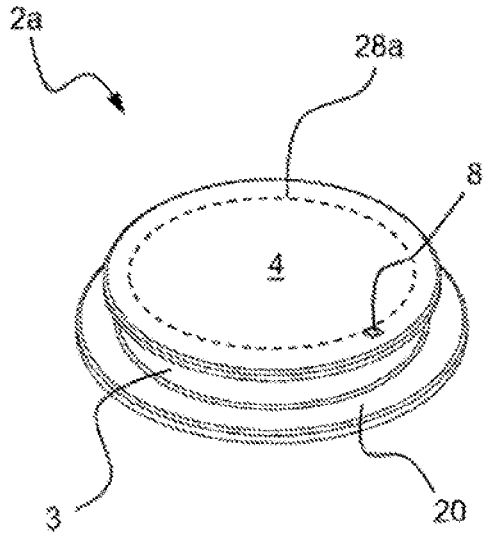
Fig. 6A Amended
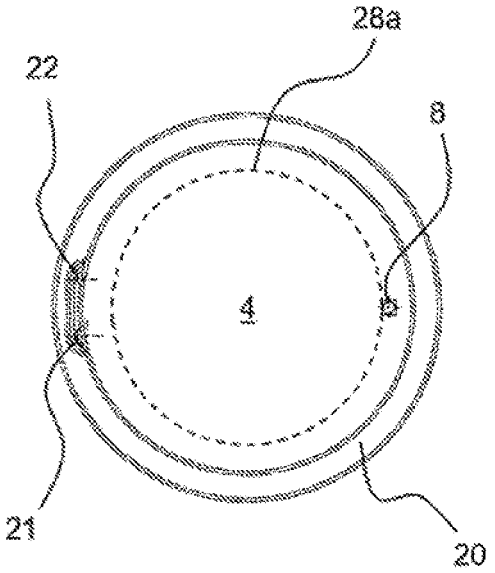
Fig. 6B Amended
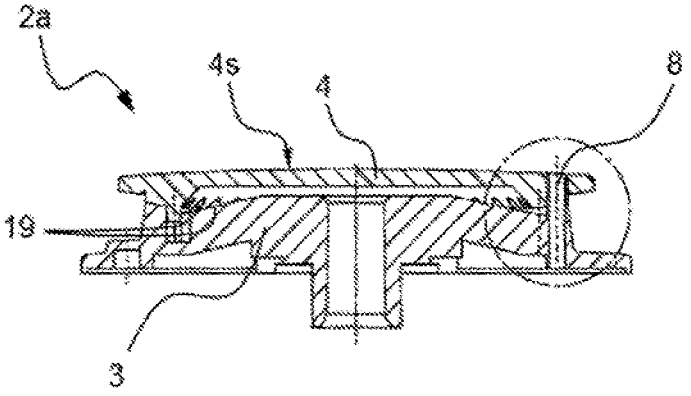
Fig. 7

GAS COOKER AND COOKING HOB ARRANGEMENT

CROSS-REFERENCES TO RELATED APPLICATIONS

This application is the U.S. National Stage of International Application No. PCT/IB2016/056430, filed Oct. 26, 2016, which designated the United States and has been published as International Publication No. WO 2017/085580 A1 and which claims the priority of Spanish Patent Application, Serial No. P201531664, filed Nov. 17, 2015, pursuant to 35 U.S.C. 119(a)-(d).

BACKGROUND OF THE INVENTION

The present invention relates to a gas cooking zone and a cooktop arrangement.

Modern household appliances are subject to stringent safety regulations. In particular, effective measures for fire prevention in relation to cooking zones, especially gas cooking zones, are required. A gas cooking zone fire can be avoided, inter alia, by always keeping the temperature of a cooking receptacle and/or pot assigned to the gas cooking zone beneath a threshold value of 250° C. This requires permanent monitoring of the temperature of the cooking receptacle. DE 199 49 601 A1 and DE 10 2007 058 945 A1 each describe, for example, a gas cooking zone with an infrared sensor which is provided laterally outside the gas burner and detects thermal radiation which is emitted from a lateral surface of a cooking receptacle.

BRIEF SUMMARY OF THE INVENTION

Against this background, an object of the present invention is to provide an improved gas cooking zone and an improved cooktop arrangement.

Accordingly, a gas cooking zone is proposed. The gas cooking zone comprises a gas burner and an infrared sensor device. The gas burner has a burner base, a burner cover and a plurality of gas outlet ports. The infrared sensor device is set up to ascertain a temperature of a cooking receptacle associated with the gas cooking zone. The gas outlet ports are arranged along a closed curve. The infrared sensor device is offset in a radially outward direction in relation to the closed curve. The infrared sensor device at least partially penetrates the burner base and the burner cover.

In particular, the infrared sensor device penetrates the burner base and the burner cover at least partially. The infrared sensor device can penetrate the burner base in that an opening is formed by the burner base, wherein the opening accommodates the infrared sensor device. The infrared sensor device can also penetrate the burner cover in that a corresponding opening is formed through the burner cover which accommodates the infrared sensor device. An opening is, in particular, formed by removing the material of the burner cover and/or the burner base, for example, by means of drilling, milling, etc.

In particular, the infrared sensor device can penetrate the burner base and/or the burner cover such that at least one infrared-transmissive section is embodied between the cooking receptacle and the infrared sensor device. The burner base and/or the burner cover can be drilled through. Furthermore, an opening which extends along a connecting line between the infrared sensor device and an underside of the cooking receptacle can be formed by the burner base and/or the burner cover.

In particular, the sensor device can be aligned in the direction of the base of the cooking receptacle. For example, the sensor device can be pointing to the cooking receptacle from bottom to top. In this case, a viewing direction of the sensor device to a surface normal of an upper side of the burner cover can form an angle of 0° to 60°. The viewing direction refers to a direction in which the sensor element and/or the light guide can detect electromagnetic radiation.

The infrared sensor device is particularly set up to detect electromagnetic radiation in a wavelength range which may correspond to a thermal oscillation of a solid body. Such electromagnetic radiation can be considered as heat radiation and/or thermal radiation.

The infrared sensor device can in particular comprise a sensor element which evaluates the incident light spectrum in the infrared wavelength range. In addition, the infrared sensor device can comprise a light guide which is set up to transmit electromagnetic radiation from or to the sensor element. The sensor element and the light guide which is coupled to the sensor element can form the infrared sensor device. In embodiments, it is possible that only the light guide assigned to the sensor element penetrates the burner base and/or the burner cover. The sensor element is then in particular mounted at a heat-protected location in or on the gas cooking zone. The sensor element can be positioned on a central control device for controlling and/or operating the gas cooking zone or a cooktop arrangement comprising a plurality of gas cooking zones.

The separate arrangement of the sensor element and the light guide has the advantage that the more heat-sensitive sensor element can be mounted at a protected location which is not exposed to the direct thermal radiation of the flames.

In this case, the sensor element and/or the light guide can penetrate the burner base and/or the burner cover at least partially. The sensor element and the light guide can jointly penetrate the burner base and/or the burner cover, i.e. be arranged in a common opening which is formed by the burner base and/or the burner cover. For example, the burner base can be penetrated by the sensor element, wherein the burner cover is penetrated by the light guide which detects thermal radiation emitted by the cooking receptacle and relays this to the sensor element. Furthermore, the infrared sensor device can be embodied such that the light guide penetrates the burner cover and/or the burner base, and the sensor element is arranged outside the gas burner.

In particular, the light guide can be arranged in the gas burner above the sensor element and be set up to detect thermal radiation from the cooking receptacle and relay this to the sensor element. Moreover, the sensor element can be arranged and set up in the gas burner to detect thermal radiation from the cooking receptacle and to relay sensor signals to further elements. The light guide can be connected from underneath to the sensor element. In particular, the sensor element and/or the light guide are aligned in the direction of the cooking receptacle. If the cooking receptacle, the temperature of which is to be determined, is arranged above the gas burner, the sensor element and/or the light guide can be directed upwards. For example, a viewing direction of the sensor device and/or the light guide to a surface normal of an upper side of the burner cover can form an angle of 0°.

The sensor element or the light guide is preferably arranged such that the viewing direction is only aligned such that it is facing an underside of a cooking receptacle and does not detect the possible flames.

The cooking receptacle can have an emission spectrum which is dependent on the temperature. In particular, the emission spectrum of the cooking receptacle may vary in the infrared wavelength range as a function of the temperature of the cooking receptacle. For example, the temperature of the cooking receptacle can be ascertained from the emission spectrum on the basis of blackbody radiation and/or Planck's Law.

By using an infrared sensor device, the temperature of the cooking receptacle can be ascertained without the need for an electrical and/or physical contact between the cooking receptacle and an element determining the temperature. In order to avoid disturbances of the detected spectrum and/or damage to the infrared sensor device by flames of the gas burner, the infrared sensor device is arranged in and/or under the burner base and the burner cover. As a result, the infrared sensor device can also be protected from mechanical and/or chemical damage, for example wear, discoloration, soiling, etc. In addition, the infrared sensor device is easier to clean as a result.

Gas outlet ports can be embodied in particular as openings in or on the burner cover and/or the burner base. In particular, the gas burner can have a cavity which is enclosed by the burner cover and/or the burner base and is suitable for generating a flammable gas mixture. The gas outlet ports may be capable of allowing the flammable gas mixture to flow out from within the gas burner to the outside thereof.

The gas outlet ports can be arranged on a closed curve in or on the gas burner. For example, the closed curve can be embodied as a circumferential curve along a circumference or parallel to a circumference of the burner base and/or the burner cover. The infrared sensor device can then be offset in relation to the closed curve in order, for example, to avoid a disturbance of the infrared sensor device by the outflowing gas.

According to one embodiment, the infrared sensor device is set up to detect thermal radiation emitted from an underside of the cooking receptacle.

The infrared sensor device can, in particular, have a detection range which corresponds to a volume, in particular of a cone, in which thermal radiation from the infrared sensor device can be detected. The infrared sensor device is preferably aligned such that the detection range covers at least part of the underside of the cooking receptacle.

In particular, the thermal radiation can have a wavelength of 750 nm to 1000 nm. In particular, the thermal radiation can lie at least partially in the infrared wavelength range. The infrared sensor device can furthermore be designed to detect electromagnetic waves outside the infrared wavelength range.

In particular, the cooking receptacle is located above the gas burner in or under which the sensor device is arranged, and the sensor device is directed at the cooking receptacle from below. Accordingly, the temperature on the underside of the cooking receptacle is detected.

According to a further embodiment, a slot is formed in the burner base and/or the burner cover for accommodating the infrared sensor device. In this case, the burner base and/or the burner cover can have a slot for accommodating the infrared sensor device.

In particular, in a plan view from above the slot can extend inwards in a straight line from one edge of the burner base and the burner cover. The slot can be milled, slit, incised, torn and/or otherwise embodied in an inwards direction, in particular from the edge of a burner cover and/or of a burner base.

The slot may relate to a gap, incision, a groove, score, notch, recess, fillet, cavity and/or a partially closed volume. The slot can in particular accommodate the infrared sensor device such that the infrared sensor device is arranged in or under the slot.

According to a further embodiment, the burner base and/or the burner cover has a bushing for accommodating the infrared sensor device.

In particular, the bushing can be embodied linearly along an axis which is perpendicular to a cover plate on which the gas cooking zone is arranged. The bushing in the burner cover and the bushing in the burner base may have a circular cross-section and be arranged coaxially, i.e. the bushings can be communicatively connected to one another.

Alternatively, or in addition, the bushings may have a circular cross-section and different diameters. For example, the bushing in the burner base may be embodied with a smaller diameter than the bushing in the burner cover. The bushing in the burner base can be set up to accommodate a light guide, while the bushing in the burner cover is set up to accommodate a sensor element. In this case, the light guide and the sensor element can each be designed in a cylindrical shape and the light guide can have a smaller diameter than the sensor element.

Furthermore, it is conceivable that the bushing in the burner base has a larger diameter than the bushing in the burner cover. The bushing in the burner cover for accommodating the light guide, and the bushing in the burner base for accommodating the sensor element can be set up accordingly.

In addition, or alternatively, a collimator, a sensor head or the like can be arranged in the bushing in the burner cover and connected to the light guide.

According to a further embodiment, the infrared sensor device has an upper side and is arranged such that the upper side is facing the cooking receptacle and is flush with a burner cover upper side. The infrared sensor device can have an upper side facing the cooking receptacle, wherein the upper side is flush with a burner cover upper side.

In particular, the upper side of the infrared sensor device may be suitable for transmitting and/or passing on incident thermal radiation to a sensor element and/or a light guide. In particular, the upper side is designed to be infrared-transmissive. The upper side can comprise a fracture and scratch-resistant material to protect the infrared sensor device from damage by a mechanical, chemical and/or electrical influence.

Due to the flush edge of the upper side with the burner cover upper side which, in particular, faces the cooking receptacle, the upper side of the infrared sensor device can also be cleaned more easily.

According to a further embodiment, the infrared sensor device has an upper side and is arranged such that the upper side is located underneath a burner cover upper side. The infrared sensor device can have an upper side, wherein the upper side is arranged inside the burner cover.

According to a further embodiment, an infrared-transmissive material is applied above an upper side of the infrared sensor device.

In particular, the upper side may represent an upper side of a sensor element of the infrared sensor device. The sensor element can be recessed, inserted or otherwise incorporated into the aforementioned slot and/or into the aforementioned bushing. It is conceivable that a light guide extends from the upper side of the sensor element to the burner cover surface. An infrared-transmissive material could be flush with the slot and/or the bushing.

In addition, or alternatively, the slot and/or the bushing can be filled with an infrared-transmissive material above the upper side of the infrared sensor device. Thereby, the infrared sensor device can be protected from mechanical, chemical and/or electrical damage.

In particular, the infrared-transmissive material has a transmission factor for electromagnetic waves in the infrared wavelength range of more than 0.5, preferably more than 0.7, and even more preferably more than 0.85. The infrared-transmissive material can, for example, comprise ionic monocrystals (for example, sodium chloride), semiconductors in monocrystalline or polycrystalline form (for example, germanium or silicon), polycristalline II-VI compounds (for example, zinc sulfides or zinc selenides), chalcogenide glasses and/or plastics based on polymethyl methacrylate.

According to a further embodiment, the gas burner has a plurality of gas outlet ports for generating flames. During normal operation of the gas burner, the flames form a flame region, and the gas outlet ports are arranged such that a region detected by the infrared sensor device is outside the flame region. The gas outlet ports and the infrared sensor device are preferably arranged such that the detected region is outside the flame region during a maximum heat output stage of the gas burner.

According to a further embodiment, the infrared sensor device is arranged inside a supporting surface of the burner cover on the burner base.

A gas cooking zone with the gas burner can have a cover plate on or at which the gas burner is positioned. The cover plate can have an opening at the position of the gas burner through which a flammable gas can be supplied to the gas burner.

The burner base can have a cylindrical form with an annular lateral surface and be embodied, for example, as a hollow cylinder, a ring and/or a circle. The cavity in the central region of the burner base, which is surrounded by the lateral surface, can be set up as a mixing chamber for mixing gas with the air. An end face of the annular lateral surface of the burner base can be used as the supporting surface on which the burner cover is supported on the burner base. Along a revolution of the lateral surface of the burner base, a plurality of bushings penetrated by the lateral surface is embodied as gas outlet ports.

A gas-air mixture from the mixing chamber can flow outwards to the gas outlet ports between an underside of the burner cover which can, in particular, be concave, and the burner base. Outside the burner base and the burner cover an ignition element can be provided which, for example, ignites the flammable gas-air mixture with the aid of a spark discharge. Thereupon, the gas-air mixture, releases energy in the form of light and heat as a result of exothermic chemical reactions. The region in which the exothermic chemical reactions take place and generate light and heat can be referred to as the flame. Each individual gas outlet port can generate a flame and, due to the buoyancy of heated gases, the flames from the gas outlet ports can mix above the burner cover. A flame region may refer to a region in which the flames mix in the aforementioned manner.

In particular, the gas outlet ports may be recessed in a region surrounding the slot and/or the bushing such that the detection range of the infrared sensor device is located outside the flame region.

An overlapping of the detection range with the flame region could lead to a fault in the detection of thermal radiation by the infrared sensor device as the flames can also emit thermal radiation. By positioning the infrared sensor device inside the supporting surface of the burner cover on the burner base, in particular inside a ring forming the lateral surface of the burner base, the detection range of the infrared sensor device can be arranged outside the flame region and the aforementioned fault avoided.

According to a further embodiment, the infrared sensor device comprises a light guide and a sensor element. To transmit thermal radiation emitted by the cooking receptacle, the light guide is set up on the sensor element. To generate sensor signals, the sensor element is set up as a function of the detected thermal radiation.

In particular, the sensor element can be a detector, a spectrometer and/or a spectroscope which are suitable for detecting and/or for measuring a radiation intensity in the infrared range.

According to a further embodiment, the light guide penetrates the burner base at least partially. In this case, the sensor element is arranged outside the gas burner.

In particular, the sensor element can be positioned underneath a cooktop plate on which the gas cooking zone is arranged.

According to a further embodiment, the gas cooking zone is coupled with a control unit for controlling the gas cooking zone. With the aid of the control unit, in particular the heating output of the gas cooking zone can be adjustable and/or variable. Furthermore, the sensor element could be coupled to the control unit and/or integrated into the control unit.

According to a further embodiment, the light guide comprises polymeric optical fibers and/or glass fibers.

Polymeric optical fibers and glass fibers can be suitable for transporting light in the infrared wavelength range. In particular, these fibers can reduce the manufacturing effort and/or manufacturing costs for the light guide.

According to a further embodiment, the gas cooking zone further comprises a pot support comprising a frame and a plurality of fingers which are directed inwards from the frame. The sensor device is embodied beneath the plurality of fingers.

In particular, an upper side of the plurality of fingers can be used as a support section for the cooking receptacle and can space the cooking receptacle from the gas burner. A finger which is located between a gas outlet port and the cooking receptacle can be heated by the flame and discharge the heat to the surroundings, in particular to the frame, which would result in a loss of energy. Therefore, it can be energetically favorable that no gas outlet ports are arranged underneath the plurality of fingers. The sensor device could be arranged underneath one of the fingers such that the detection range is outside the flame region. As a result, a fault in the detection of the thermal radiation by the infrared sensor device can be prevented.

Furthermore, a cooktop arrangement comprising one or more gas cooking zones mentioned above or hereinafter is proposed.

Such a cooktop arrangement is capable of adapting a heat output to the gas cooking zone as a function of detected thermal radiation which, in particular, can be converted into a temperature of the cooking receptacle. In this way, in particular, it can be ensured that the cooking receptacle is not heated excessively, i.e. that the cooking receptacle is not heated to a temperature above a predeterminable limit value.

According to a further embodiment, the cooktop arrangement further comprises a control unit. The infrared sensor device of the at least one gas cooking zone is arranged to generate sensor signals as a function of detected thermal radiation and to transmit these to the control unit.

According to a further embodiment, the control unit controls a heat output of the gas cooking zone as a function of the sensor signals.

The control unit can be set up to control a heat output of each of the at least one gas cooking zones as a function of the detected thermal radiation. In particular, in this case, a flow rate of the flammable gas-air mixture to the respective gas burners can be controlled. The sensor signals of the infrared sensor device can be transmitted, for example, electrically, magnetically, mechanically, acoustically and/or optically.

Furthermore, the control unit can be coupled with the sensor element of the infrared sensor device, accommodate it and/or comprise it. Accordingly, the light guide of the infrared sensor device can supply the detected thermal radiation to the control unit, and the control unit can generate corresponding sensor signals.

Further possible implementations of the invention do not comprise explicitly mentioned combinations of features or embodiments described previously or hereinafter with regard to the exemplary embodiments either. The person skilled in the art will also add individual aspects as improvements or supplements to the respective basic form of the invention.

BRIEF DESCRIPTION OF THE DRAWINGS

Further advantageous embodiments and aspects of the invention are the subject matter of the subclaims and of the exemplary embodiments of the invention described hereinafter. The invention is explained in more detail hereinafter on the basis of preferred embodiments with reference to the attached figures.

FIG. 4A and FIG. 4B show a perspective view and a top view of a first embodiment of a gas burner;

FIG. 5 shows a front view of the gas burner from FIG. 4A and FIG. 4B in a partial cross-sectional view;

FIG. 6A and FIG. 6B show a perspective view and a top view of a second embodiment of a gas burner;

FIG. 7 shows a front view of the gas burner from FIG. 6A and FIG. 6B in a partial cross-sectional view.

DETAILED DESCRIPTION OF EXEMPLARY EMBODIMENTS OF THE PRESENT INVENTION

Figure 1:
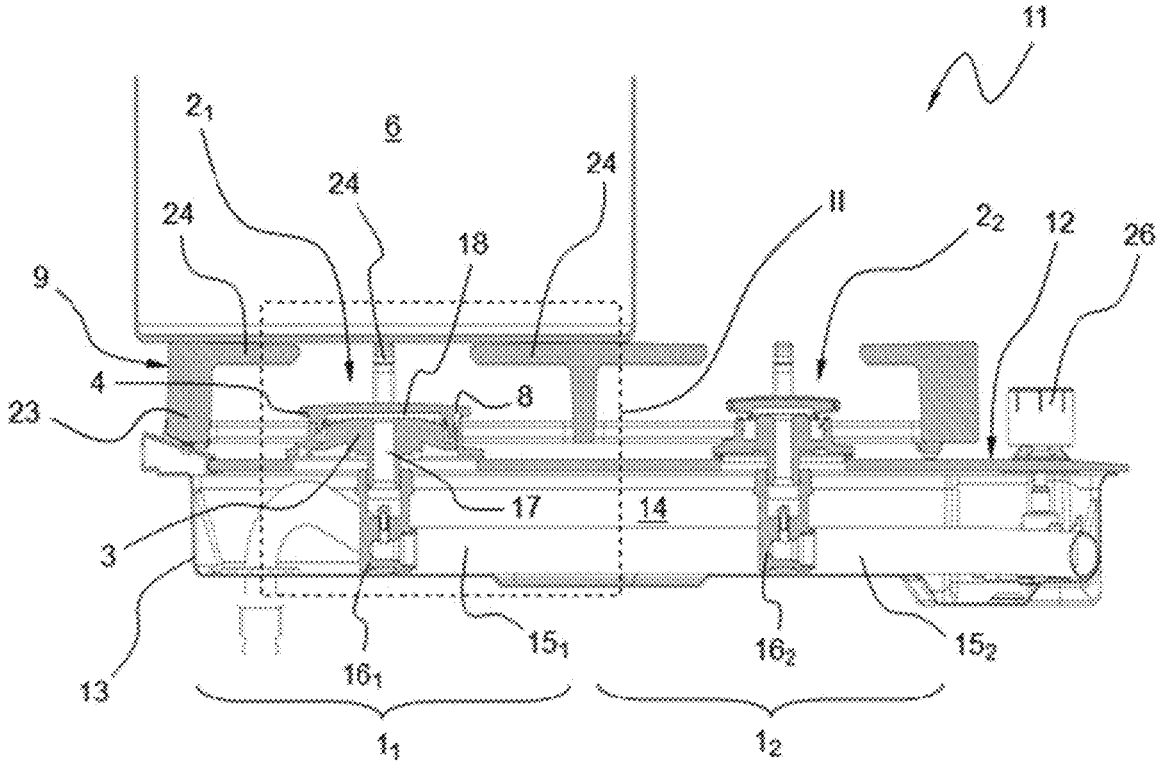
FIG. 1 shows a diagrammatic cross-sectional view of an embodiment of a cooktop arrangement.

In the figures, elements which are the same or have the same function have been provided with the same reference characters, unless specified otherwise.

Figure 2:
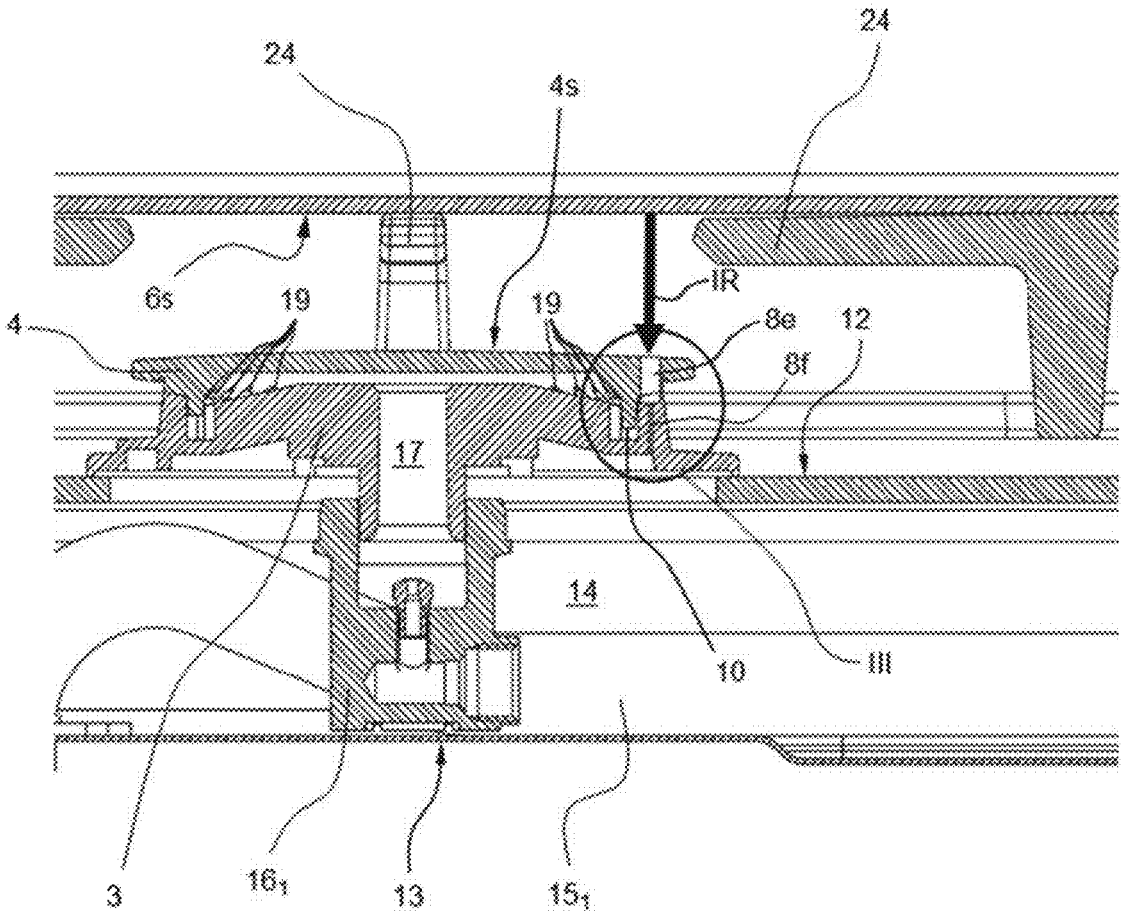
FIG. 2 shows a partial view II from FIG. 1.

FIG. 1 shows a diagrammatic cross-sectional view of a first embodiment of a cooktop arrangement 11. FIG. 2 shows a partial view II from FIG. 1.

The cooktop arrangement 11 has at least two cooking zones 12, each comprising one gas burner $\mathbf{2}_1$, $\mathbf{2}_2$. Furthermore, the cooktop arrangement 11 comprises a cover plate 12 on which the gas burners $\mathbf{2}_1$, $\mathbf{2}_2$ are arranged. A cooktop trough 13 is arranged beneath the cover plate 12 which closes a space 14 beneath the cover plate 12. Gas feed lines $\mathbf{15}_1$, $\mathbf{15}_2$ which are each connected to the gas burners $\mathbf{2}_1$, $\mathbf{2}_2$ and supply them with gas are arranged in the subspace 14. The gas burner $\mathbf{2}_1$ comprises a burner cover 4, a burner base 3 and a burner lower part 16.

The burner base 3, which in particular may have a circular cross-section, is supported on the cover plate 12. The burner base 3 has a cylindrical form with a lateral surface enclosing a cavity which serves as a mixing chamber 17 and in which the supplied gas is mixed with the air. The burner cover 4 is supported on an end face of the burner base 3. The burner cover 4 and the burner base 3 are arranged in surface contact with one another in a circumferential region 10. For example, a circumferential projection is formed on an underside of the burner cover 4 and a circumferential groove is formed on the end face of the burner base 3, wherein the projection can engage in the groove. The burner cover 4 is disc-shaped.

A cavity 18 is formed between the underside of the burner cover 4 and the burner base 3, to convey a gas-air mixture generated in the mixing chamber 17 to gas outlet ports 19. The gas outlet ports 19 are embodied as through-openings in the lateral surface of the burner base 3 and enable the gas-air mixture to flow out of the cavity 18. In FIGS. 1 and 2 the gas outlet ports 19 are radial. The outflowing gas-air mixture flows radially outwards underneath a lateral projection of the burner cover 4 and can be ignited.

Furthermore, the gas cooking zone $\mathbf{1}_1$ has a pot support 9 for spacing a cooking receptacle 6 assigned to the gas cooking zone $\mathbf{1}_1$. The pot support 9 comprises a frame 23 which is formed around the gas burner $\mathbf{2}_1$, and a plurality of fingers 24, which are formed inwards from the frame 23. In particular, the fingers 24 are designed and arranged such that the cooking receptacle 6 can rest in a stable manner on an upper side of the fingers 24.

A narrow bushing 8*f* in which a light guide 5*f* is accommodated is embodied in the burner base. Coaxially with respect to the bushing 8*f*, a further bushing 8*e* is formed in the burner cover 4 which accommodates a sensor element 5*e*. Together with the light guide 5*f*, the sensor element 5*e* forms an infrared sensor device 5 which is suitable for detecting thermal radiation IR emitted by an underside 6*s* of the cooking receptacle 6. The infrared sensor devices 5*e*, 5*f* thus penetrate the burner base 3 and the burner cover 4.

FIG. 3A to FIG. 3E show embodiments of a bushing 8*e*, 8*f* in a partial view III from FIG. 2.

Figure 3A:
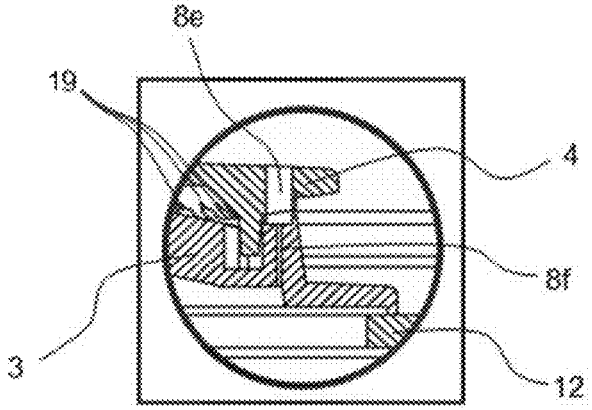
FIG. 3A to FIG. 3E show embodiments of a bushing in a partial view III from FIG. 2.

In FIG. 3A a first bushing 8*e* is embodied in the burner cover 4. The first bushing 8*e* has a circular cross-section and is set up to accommodate a sensor element 5*e*. A second bushing 8*f*, which has a circular cross-section with a smaller diameter than the first bushing 8*e*, is embodied in the burner base 3 and accommodates the light guide 5*e* which is connected to the sensor element 5*e*.

Figure 3B:
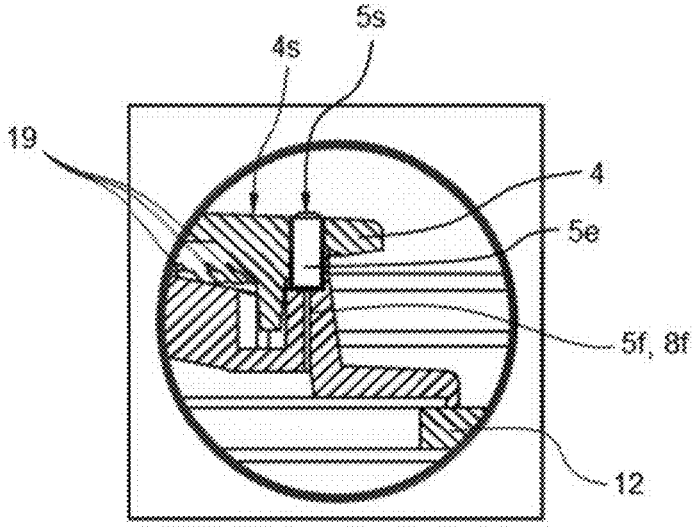

The sensor element 5*e* can at least partially fill the first bushing 8*e*. FIG. 3B shows a sensor element 5*e* which completely fills the first bushing 8*e* in the burner cover 4. An upper side 5*s* of the sensor element 5*e* is arranged flush with a burner cover upper side 4*s*.

If the sensor element 5*e* has a smaller volume than the capacity of the first bushing 8*e*, the remaining volume of the first bushing can be filled with an infrared-transmissive material. The light guide 5*f* is guided through a second bushing 8*f* in the burner base 3.

Figure 3C:
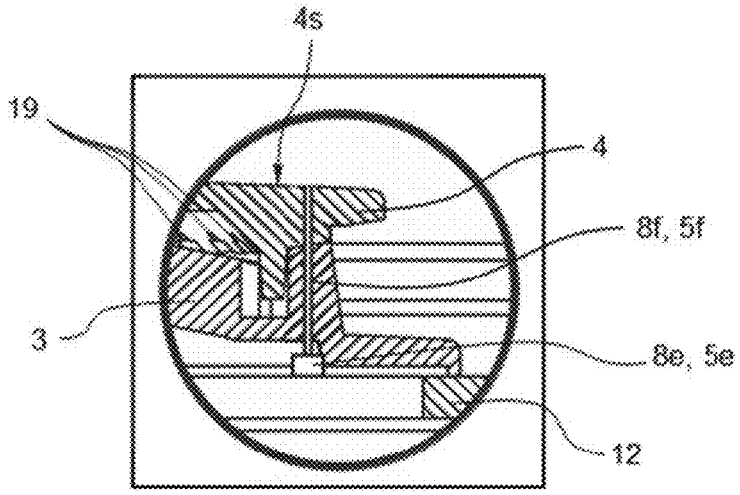

In FIG. 3C a bushing 8*f* penetrates both the burner cover 4 and the burner base 3 and is set up to accommodate a light guide 5*f*. A sensor element 5*e* can be positioned and connected to the light guide 5*f* beneath the burner base 3.

Figure 3D:
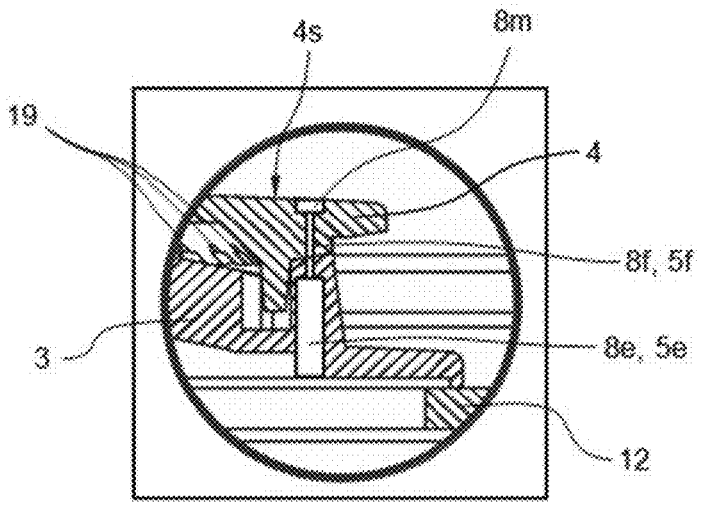

In FIG. 3D, the burner base 3 is partially penetrated by a first bushing 8*e* and partially penetrated by a second bushing 8*f*. The second bushing 8*f* for accommodating a light guide 5*f* is embodied in the burner cover 4. A further bushing 8*m* is embodied close to the surface of the burner cover surface 4*s* and is arranged coaxially with respect to the second bushing 8*f*. The further bushing 8*m* is filled with an infrared-transmissive material. Incident thermal radiation IR can pass through the infrared-transmissive material and reach the light guide 5*f* in the second bushing 8*f* which transmits the thermal radiation IR to a sensor element 5*e*.

Figure 3E:
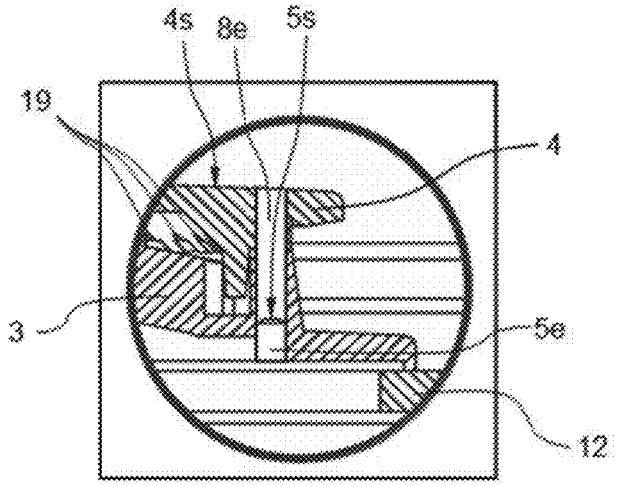

In FIG. 3E, a first bushing 8*e* penetrates both the burner base 3 and the burner cover 4. In this case, a sensor element 5*e* has an upper side 5*s* and is arranged such that the upper side 5*s* is located beneath the burner cover upper side 4*s*. The first bushing 8*e* can be filled up to the burner cover upper side 4*s* above the upper side 5*s* with an infrared-transmissive material.

Furthermore, it is conceivable (not shown) that the sensor element 5*e* is arranged outside the gas burner 2 or at a distance from the gas burner 2, for example, beneath the cover plate 12. Accordingly, the light guide 5*f* at least partially penetrates the burner base 3, the burner cover 4 and/or the cover plate 12.

FIG. 4A and FIG. 4B show a perspective view and a top view of a further embodiment of a gas burner 2. FIG. 5 shows a front view of the gas burner 2 in a partial cross-sectional view.

The gas burner 2 has a ring element 20 which is supported on an upper side of the cover plate 12 and is set up to hold the gas burner 2*a* in position on the cover plate 12. The burner base 3 has a plurality of gas outlet ports 19 which are arranged along or on a closed curve 28. In particular, the closed curve 28 is circular in design and runs parallel to a circumference of the burner base 3. The gas outlet ports 19 are through-openings which enable a gas or gas mixture to flow out of a cavity which is enclosed by the burner base 3 and the burner cover 4.

The gas burner 2 has a slot 7 which is embodied in a straight line inwards from an edge of the burner base 3 and the burner cover 4 respectively, for example, is radially recessed, incised and/or milled. The infrared sensor device 5 is arranged in the slot 7, wherein the upper side 5*s* of the infrared sensor device 5 points upwards to detect thermal radiation IR from a lower side of the cooking receptacle 6 positioned above the gas burner 2. In particular, the slot 7 is positioned on the closed curve 28.

Furthermore, the gas burner 2 has an ignition element 21 and a thermocouple 22. The ignition element 21 is set up to ignite the gas-air mixture flowing out with the aid of a spark discharge, i.e. to initiate exothermic chemical reactions for the generation of light and heat. As a result, a flame region which is formed by a combination of a plurality of flames from the gas outlet ports 19 is generated. The thermocouple 22 is set up to determine a temperature in the flame region.

The gas outlet ports 19 are recessed in the vicinity of the slot 7, i.e. no flame is generated in the immediate vicinity of the slot 7. Consequently, a detection range of the infrared sensor device 5 positioned in the slot 7 lies outside the flame region. In addition, the infrared sensor device 5 can be radially positioned outside the closed curve 28 to prevent overlapping of the flame region with a region in which the infrared sensor device 5 can detect the thermal radiation IR.

FIG. 6A and FIG. 6B show a perspective view and a top view of a second embodiment of a gas burner 2*a*. FIG. 7 shows a front view of the gas burner 2*a* in a partially cross-sectional view.

The gas burner 2*a* essentially has the same structure as that of the gas burner 2, wherein the slot 7 of the gas burner 2 is replaced by a bushing 8. The bushing 8 is perpendicular. The bushing 8 penetrates a burner base 3 and a burner cover 4 and is set up to accommodate an infrared sensor device which comprises a sensor element and a light guide and can be directed upwards. In particular, the bushing 8 is offset in a radially outward direction in relation to the closed curve 28 on which the gas outlet ports 19 are arranged. Thus, a flame or a flame region which is generated at the gas outlet ports 19 during normal operation of the gas burner 2*a* can be embodied outside a region in which an infrared sensor device accommodated in the bushing 9 detects the thermal radiation IR.

The gas outlet ports 19 are recessed in the vicinity of the bushing 8 such that a detection range of the infrared sensor device 5 lies outside the flame region.

Figure 8:
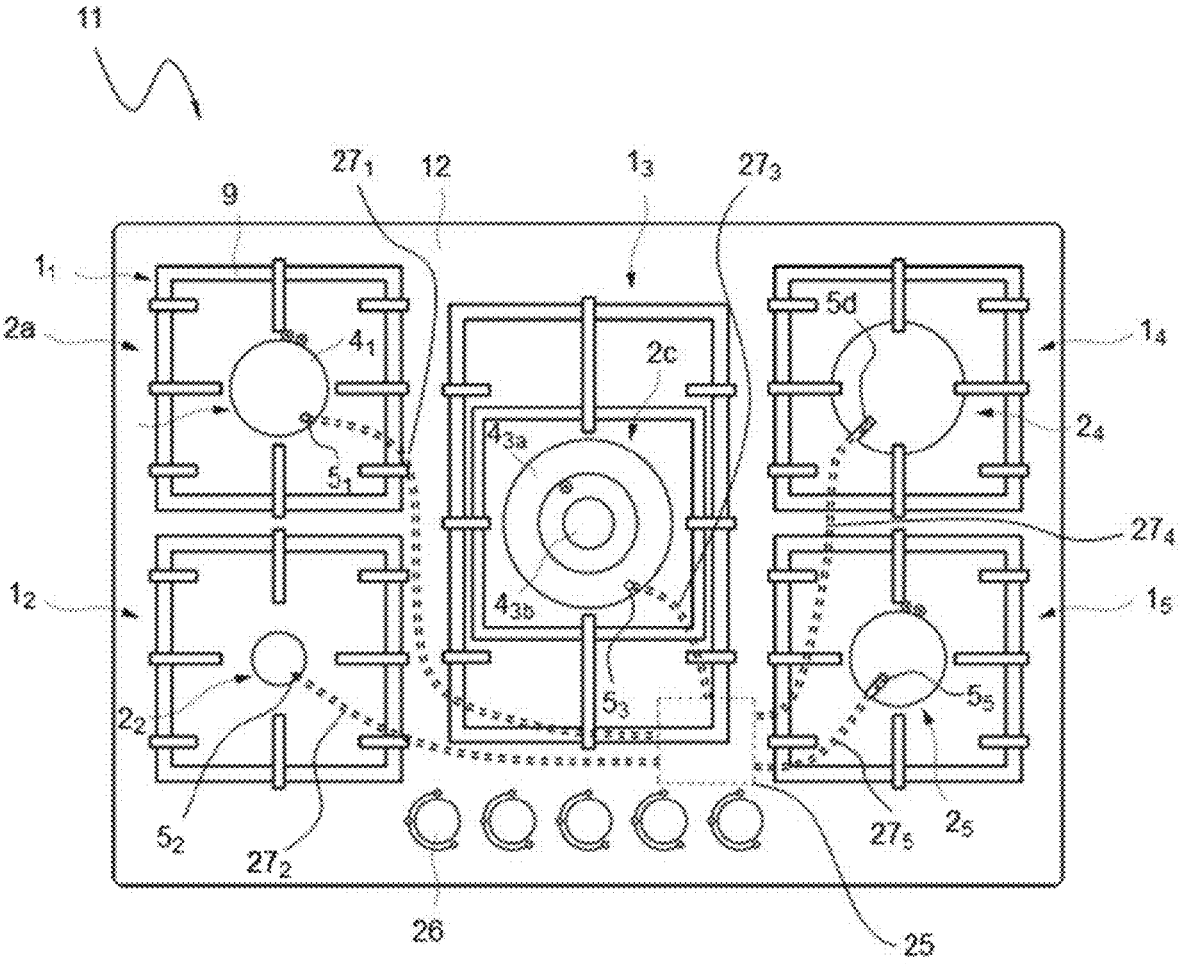
FIG. 8 shows a top view of an embodiment of a cooktop arrangement.

FIG. 8 shows a top view of an embodiment of a cooktop arrangement 11.

The gas cooking zones $\mathbf{1}_1$-$\mathbf{1}_5$ each comprise a gas burner $\mathbf{2}_1$-$\mathbf{2}_5$. The gas burners $\mathbf{2}_1$-$\mathbf{2}_5$ each have a burner base and a burner cover and are arranged to generate a flame region.

The gas burners $\mathbf{2}_1$-$\mathbf{2}_3$ each have a bushing in which the respective infrared sensor device $\mathbf{5}_1$-$\mathbf{5}_3$ is arranged. The gas cooking zones $\mathbf{2}_4$-$\mathbf{2}_5$ each have a slot in the burner cover and in the burner base in each of which an infrared sensor device $\mathbf{5}_4$-$\mathbf{5}_5$ is arranged. All the infrared sensor devices $\mathbf{5}_1$-$\mathbf{5}_5$ are set up to detect thermal radiation which is emitted by a cooking receptacle associated with the respective cooking zone and to generate sensor signals as a function of the detected thermal radiation. The infrared sensor devices $\mathbf{5}_1$-$\mathbf{5}_5$ are each connected to a control unit 25 by way of an electrical and/or optical line $\mathbf{27}_1$-$\mathbf{27}_5$ and are set up to transmit sensor signals to the control unit 25. The control unit 25 is arranged to regulate a gas supply to the respective gas cooking zones $\mathbf{1}_1$-$\mathbf{1}_5$ as a function of received sensor signals.

Alternatively, the sensor element 5*e* is integrated into the control unit 25 or the control unit 25 comprises the sensor element 5*e*. The detected thermal radiation IR is routed to the control unit 25 by way of the respective light guide 5*f* and by way of the optical lines $\mathbf{27}_1$-$\mathbf{27}_5$. The sensor element 5*e* or the control unit 25 generates the sensor signals as a function of the received thermal radiation IR.

Although the present invention was described with reference to exemplary embodiments, it can be modified in a variety of ways.

The invention claimed is:

1. A gas cooking zone, comprising:

a gas burner having a burner base, a plurality of gas outlet ports, said gas outlet ports being disposed on a closed curve, and a burner cover, the burner cover having a periphery extending in a radially outward direction from the closed curve; and an infrared sensor device configured to ascertain a temperature of a cooking receptacle associated with the gas cooking zone, said infrared sensor device being either disposed on the closed curve or disposed offset in a radially outward direction from the closed curve and at least partially penetrating the burner base and the periphery of the burner cover.

2. The gas cooking zone of claim 1, wherein the infrared sensor device comprises a sensor element and a light guide arranged on the sensor element to transmit thermal radiation emitted by the cooking receptacle, said sensor element configured to generate a sensor signal as a function of a detected thermal radiation.

3. The gas cooking zone of claim 2, wherein the light guide is sized to at least partially penetrate at least one of the burner base and the burner cover, said sensor element being arranged outside the gas burner.

4. The gas cooking zone of claim 1, wherein the plurality of gas outlet ports is configured to generate a flame which forms a flame region during normal operation of the gas burner, said plurality of gas outlet ports being arranged such that a region detected by the infrared sensor device lies outside the flame region at maximum heat output of the gas burner.

5. The gas cooking zone of claim 1, wherein the infrared sensor device is configured to detect a thermal radiation emitted from an underside of the cooking receptacle.

6. The gas cooking zone of claim 1, wherein at least one of the burner base and the burner cover has a bushing for accommodating the infrared sensor device.

7. The gas cooking zone of claim 1, wherein at least one of the burner base and the burner cover has a slot for accommodating the infrared sensor device.

8. The gas cooking zone of claim 1, wherein the infrared sensor device has an upper side which faces the cooking receptacle and is flush with an upper side of the burner cover.

9. The gas cooking zone of claim 1, wherein the infrared sensor device has an upper side arranged inside the burner cover.

10. The gas cooking zone of claim 1, further comprising an infrared-transmissive material mounted above an upper side of the infrared sensor device.

11. The gas cooking zone of claim 1, wherein the burner base has an annular supporting surface on or against which the burner cover is supported, said infrared sensor device being arranged in the burner base and/or the burner cover inside the supporting surface.

12. The gas cooking zone of claim 1, further comprising a pot support comprising a frame and a plurality of fingers which are directed inwards from the frame, said infrared sensor device being embodied below one of the plurality of fingers.

13. A cooktop arrangement, comprising a gas cooking zone, said gas cooking zone including a gas burner having a burner base, a plurality of gas outlet ports, said gas outlet ports being disposed on a closed curve, and a burner cover, the burner cover having a periphery extending in a radially outward direction from the closed curve, and an infrared sensor device configured to ascertain a temperature of a cooking receptacle associated with the gas cooking zone, said infrared sensor device being either disposed on the closed curve or disposed offset in a radially outward direction from the closed curve and at least partially penetrating the burner base and the periphery of the burner cover.

14. The cooktop arrangement of claim 13, further comprising a control unit, said infrared sensor device of the gas cooking zone configured to generate a sensor signal as a function of a detected thermal radiation and to transmit the detected thermal radiation to the control unit.

15. The cooktop arrangement of claim 14, wherein the control unit is configured to control a heat output of the gas cooking zone as a function of the sensor signal.

16. The cooktop arrangement of claim 13, wherein the infrared sensor device comprises a sensor element and a light guide arranged on the sensor element to transmit thermal radiation emitted by the cooking receptacle, said sensor element configured to generate a sensor signal as a function of the detected thermal radiation.

17. The cooktop arrangement of claim 16, wherein the light guide is sized to at least partially penetrate at least one of the burner base and the burner cover, said sensor element being arranged outside the gas burner.

18. The cooktop arrangement of claim 13, wherein the plurality of gas outlet ports is configured to generate a flame which forms a flame region during normal operation of the gas burner, said plurality of gas outlet ports being arranged such that a region detected by the infrared sensor device lies outside the flame region at maximum heat output of the gas burner.

19. The cooktop arrangement of claim 13, wherein the infrared sensor device is configured to detect a thermal radiation emitted from an underside of the cooking receptacle.

20. The cooktop arrangement of claim 13, wherein at least one of the burner base and the burner cover has a bushing for accommodating the infrared sensor device.

21. The cooktop arrangement of claim 13, wherein at least one of the burner base and the burner cover has a slot for accommodating the infrared sensor device.

22. The cooktop arrangement of claim 13, wherein the infrared sensor device has an upper side which faces the cooking receptacle and is flush with an upper side of the burner cover.

23. The cooktop arrangement of claim 13, wherein the infrared sensor device has an upper side arranged inside the burner cover.

24. The cooktop arrangement of claim 13, wherein the gas cooking zone includes an infrared-transmissive material mounted above an upper side of the infrared sensor device.

25. The cooktop arrangement of claim 13, wherein the burner base has an annular supporting surface on or against which the burner cover is supported, said infrared sensor device being arranged in the burner base and/or the burner cover inside the supporting surface.

26. The cooktop arrangement of claim 13, further comprising a pot support comprising a frame and a plurality of fingers which are directed inwards from the frame, said infrared sensor device being embodied below one of the plurality of fingers.

* * * * *